United States Patent [19]

Ericksen

[11] 4,016,921

[45] Apr. 12, 1977

[54] LATCHING MECHANISM ADAPTABLE FOR USE WITH STRETCHABLE FARM GATES

[76] Inventor: Clarence H. Ericksen, R.R. No. 2, Neola, Iowa 51559

[22] Filed: Sept. 19, 1975

[21] Appl. No.: 614,881

[52] U.S. Cl. ..... 160/328; 292/247
[51] Int. Cl.[2] ..... E06B 3/80
[58] Field of Search ..... 160/328, 327; 292/247

[56] References Cited

UNITED STATES PATENTS

| | | | |
|---|---|---|---|
| 402,439 | 4/1889 | Haas | 160/328 |
| 807,591 | 12/1905 | Batzler | 160/328 |
| 1,190,040 | 7/1916 | Teeters | 160/328 |
| 1,392,934 | 10/1921 | Glandt | 292/247 |
| 1,843,053 | 1/1932 | Voll et al. | 160/328 |
| 2,859,944 | 11/1958 | Cisney | 160/328 X |

*Primary Examiner*—Philip C. Kannan
*Attorney, Agent, or Firm*—George R. Nimmer

[57] ABSTRACT

There is provided an exceptionally reliable and sturdy gate latching assembly having particular utility with horizontally longitudinally stretchable farm gates such as those comprising lengthy horizontal wire strands. The gate latching assembly generally comprises an upright elongate lineal shaft that is attached to the fence post so as to be rotational about the shaft vertical-axis, one or more vertically separated radial lugs each co-rotatably attached to the upright shaft, a C-shaped link having its first-end pivotably attached to a radial lug and having its second-end provided with a vertical perforation to removably latchably accommodate a dog depending from the gate free-end, handle means to facilitate rotation of the upright shaft so the link pivotably restrained first-end is caused to move from a rearward latching-station to a forward locking-station, and arresting means cooperating with the handle means to arrest rotation of the upright shaft after the gate dog has been moved to the forward locking-station through the forwardly moved C-shaped link thereby stretchably urging the farm gate closely toward the fence post.

9 Claims, 4 Drawing Figures

PRIOR ART
FIG. 1
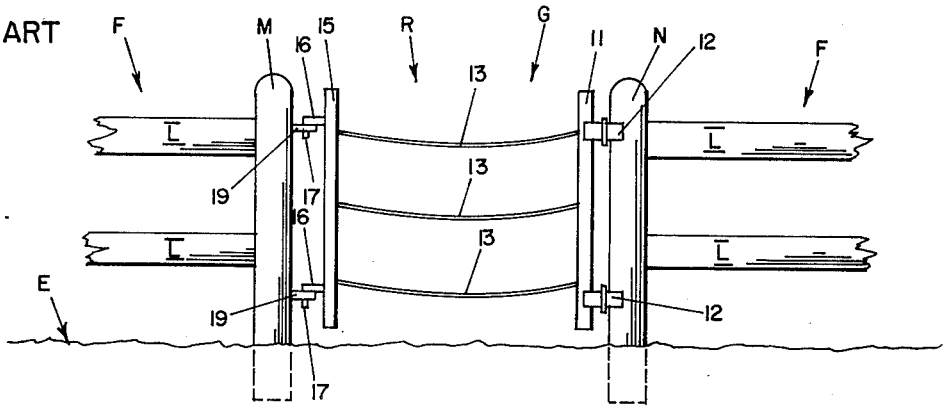
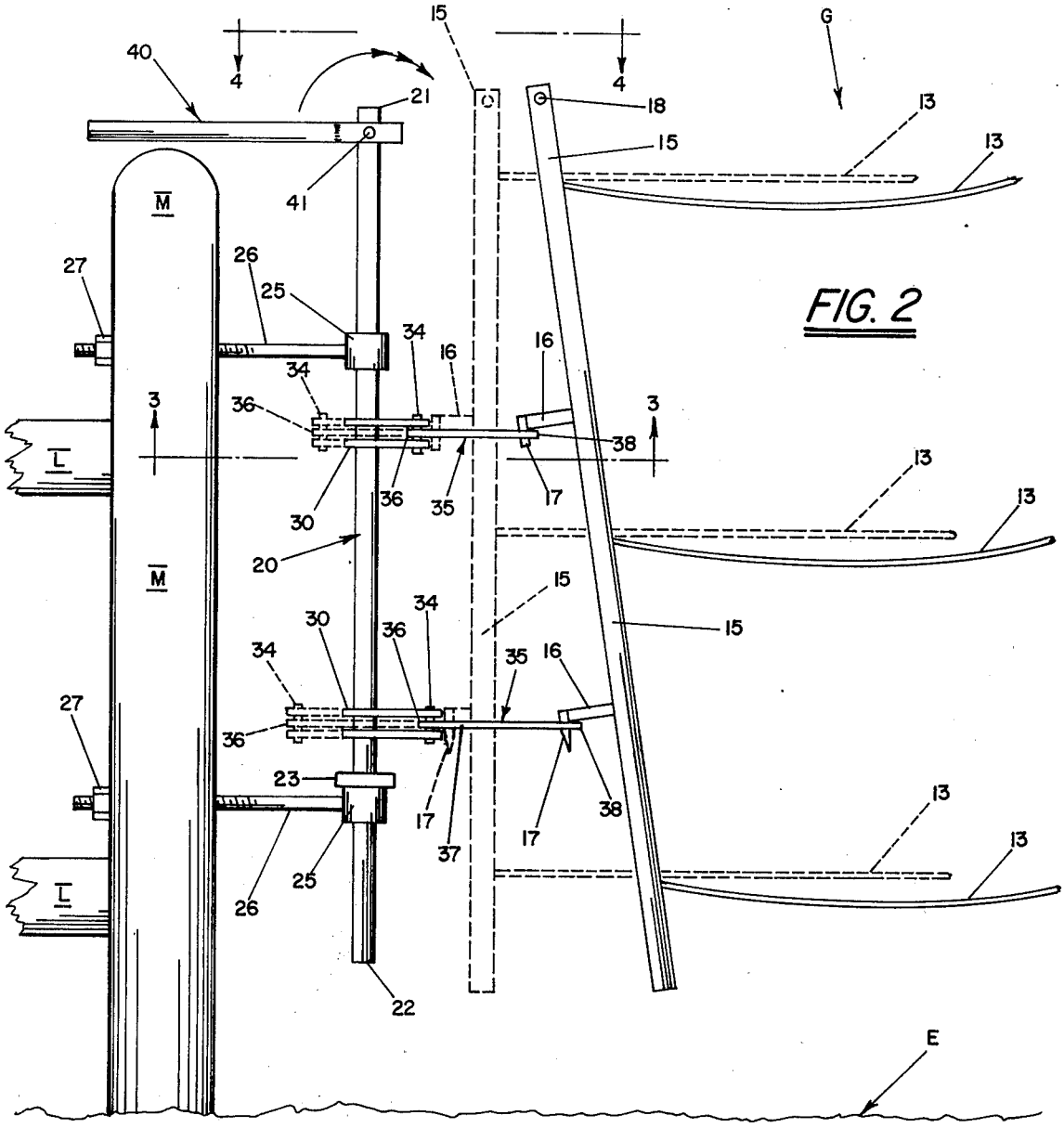
FIG. 2

FIG. 4
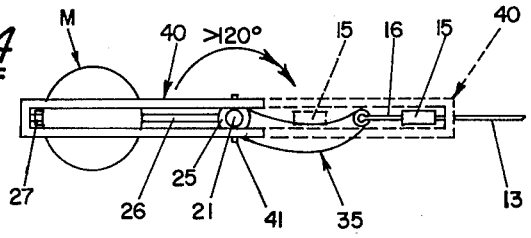
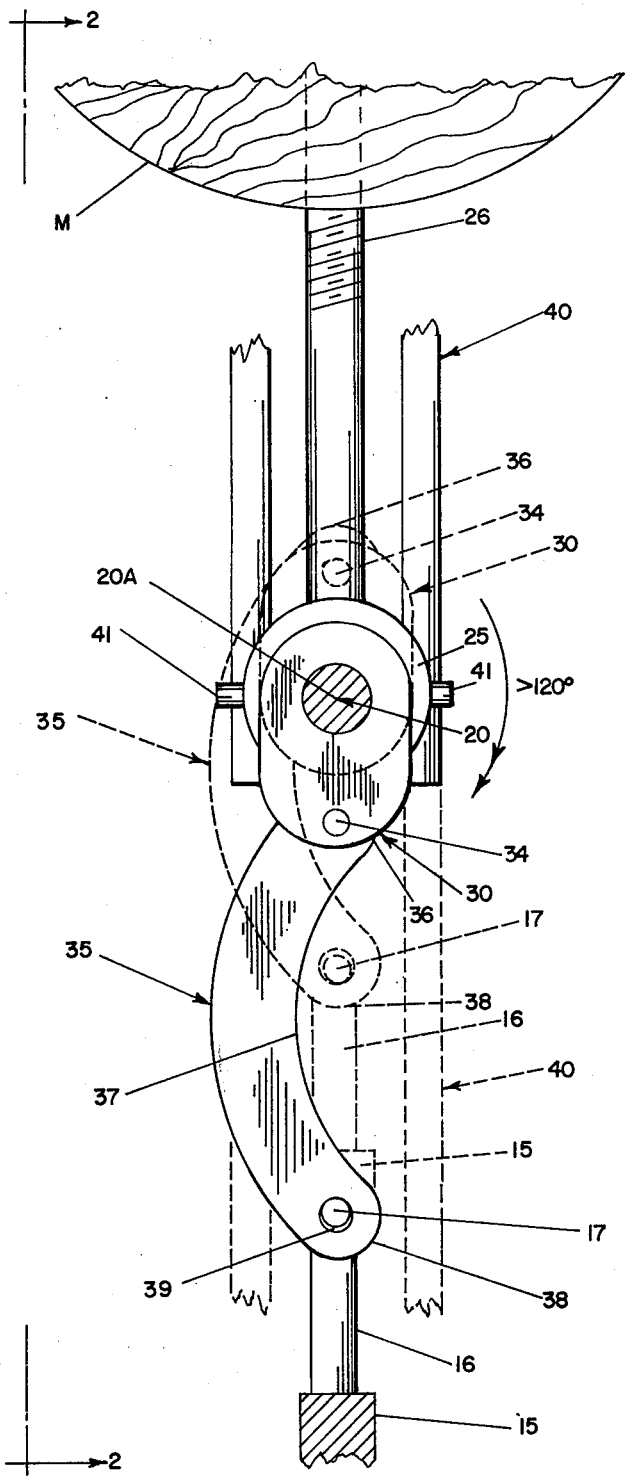
FIG. 3

LATCHING MECHANISM ADAPTABLE FOR USE WITH STRETCHABLE FARM GATES

Pivotal farm gate closures are utilized between the longitudinally extending fence opening defined by an upright fore-post longitudinally separated by an upright rear-post. Oftentimes pivotal farm gates are constructed of lengthy horizontal wire strands extending longitudinally between the upright free-end and pivotably restrained-end of the farm gate whereby the gate is horizontally longitudinally stretchable therebetween. Over a period of time, such longitudinally stretchable farm gates begin to sag or droop structurally and hence latching with the fence upright fore-post is no longer sufficiently tight thereby permitting farm animals to escape at the gap between the fence fore-post and the free-end of the latchably closed farm gate.

It is accordingly the general object of the present invention to provide an exceedingly reliable latching mechanism which can be readily installed adjacent the upright free-end of pivotal farm gates.

It is an ancillary general object to provide a farm gate latching mechanism which is particularly well suited for longitudinally stretchable farm gates thereby ensuring that a spatially close relationship is attained between the closed farm gate and the adjacent fencework thereby preventing escape of farm animals.

It is another object to provide a farm gate latching mechanism which can be readily installed as an addendum proximal to the gate free-end without the necessity for removing the gate from its pivotal connection nor for structurally modifying the farm gate.

It is a further object to provide a gate latching mechanism of simple, reliable, and economical construction that is amenable as an addendum for various styles of farm fences and gates.

With the above and other objects and advantages in view, which will become more apparent as this description proceeds, the gate latching mechanism of the present invention comprises an upright elongate shaft attachable to the stationary fence post and revolvable about the shaft vertical-axis, at least one radial lug co-revolvable with the upright shaft, a C-shaped link having its first-end pivotably attached to a radial lug and having its perforate second-end removably latchably engageable with a dog depending from the gate free-end, handle means for rotating the upright shaft whereby the link first-end is caused to move from a rearward latching-station to a forward locking-station, and arresting means for the upright shaft at the forward locking-station wherein the farm gate is stretchably urged toward the stationary fence post.

In the drawing, wherein like characters refer to like parts in the several views, and in which:

FIG. 1 is a longitudinally extending side elevational view of a conventional farm fence opening and a pivotal gate closure therefor, which offer a typical prior art environment for the novel latching mechanism of the present invention.

FIG. 2 is a side elevational detail view with the novel latching mechanism of the present invention included into the FIG. 1 typical prior art environment as an addendum thereto, FIG. 3 is a sectional plan view taken along line 3—3 of FIG. 2, FIG. 4 is a top plan view of the FIG. 2 installation.

In FIGS. 2–4, the gate latching-station is shown in solid line while the locking-station is shown in phantom line.

FIG. 1 shows a typical prior art stretchable farm gate for the latching mechanism of the present invention. Fence "F" includes a longitudinally extending opening "R" defined by a pair of longitudinally separated upright stationary fence posts embedded into the earth's surface "E" including a fore-post "M" and a rear-post "N". A typical horizontally longitudinally stretchable upright farm gate closure "G" for fence opening "R" comprises a pair of longitudinally separated upright columnar gate terminii including a rearward restrained-end 11 that is pivotably attached as with hinges 12 to fence rear-post "N" and a forward columnar free-end 15. Gate free-end 15 is removably latchable to the fence fore-post "M", and in this vein, column 15 is shown equipped with a pair of vertically separated dogs 17 each forwardly offset and depending from free-end 15 as by the horizontal longitudinal projections 16 of gate free-end 15. Dogs 17 are removably latchably inserted as by U-shaped horizontal brackets 19 extending longitudinally rearwardly from fore-post "M" at vertically separated locations therefrom. Farm gate "G" is of the prevalent longitudinally stretchable type (such as comprising horizontal barbed-wire flexible strands 13 connecting ends 11 and 15) which is illustrated by the downwardly sagging or drooping nature of strands 13 in FIG. 1. With such typical stretchable farm gate constructions, even at FIG. 1 latched (19) condition livestock oftentimes can escape at the slack between the gate free-end 15 and the fence fore-post "M". However, livestock escape is effectively precluded with the latching mechanism of the present invention (e.g. FIGS. 2–4) which replaces the brackets 19 indicative of the prior art.

Turning henceforth to FIGS. 2–4, the latching mechanism concept of the present invention comprises an upright elongate lineal shaft 20 having a top-end 21 and a bottom-end 22 which is preferably located above the earth's surface "E". In FIGS. 2–4 structural components of the latching mechanism and gate at latching-station are shown in solid line and at locking-station are shown in phantom line. Upright shaft 20 is rearwardly offset from and preferably parallel to the fore-post "M". Moreover, as indicated by the double-headed curved arrow in FIGS. 3 and 4, upright shaft 20 is rotational about its vertical-axis 20A for an angular extent of at least 120° (and preferably some 170° – 190°) commencing at latching-station and terminating at locking-station. Rotational connection of upright shaft 20 is herein afforded through a pair of bearings 25 including an upper-bearing and a lower-bearing, the bearings 25 being readily attached to fore-post "M" with threaded horizontal studs 26 having nuts 27. Maintenance of the shaft bottom-end 22 above the earth's surface "E" is herein provided by a collar 23 integrally connected to shaft 20 and resting against the lower-bearing, although lugs 30, etc., might be similarly employed.

There is at least one radial lug (e.g. 30) each rigidly attached to (e.g. as by welding) and extending radially outwardly from the upright shaft 20 whereby the shaft and lugs are co-rotatable about the shaft vertical-axis 20A. At the latching-station the radial lugs extend horizontally rearwardly of shaft 20 while at locking-station the same lugs extend horizontally radially forwardly of said shaft 20. As best seen in FIG. 3, oval-shaped lugs 30 are employable with the oval's major-axis and a minor-axis intersecting within the shaft 20. Preferably, there is a pair of vertically separated lugs, near the upper-bearing 25 and near the lower-bearing 25, each lug being associated with a single C-shaped horizontal link 35. It is desirable that the upper-lug and the lower-lug each represent a dual-lugs configuration with the C-shaped link 35 disposed therebetween as shown in FIG. 2, for a total of four lugs 30 and two links 35.

For each of the C-shaped horizontal links 35, there is a first-end 36 thereof pivotably attached to the lug at a location radially outwardly from the upright shaft 20. In this vein, a vertical pivot-pin 34 is employed to pivotably attach each link's first-end 36 to each lug 30. The rearward second-end 38 of each link is provided with a vertical perforation 39 therethrough whereby the gate dog 17 is loosely removably insertible through said perforation 39 when the gate free-end 15 and the latching mechanism (e.g. 30,35) are at rearward latching-station. In the preferred situation wherein two vertically separated C-shaped links 35 are employed, the lower dog 17 is vertically lengthier than is the upper dog 17 to facilitate insertion of the respective dogs 17 of the drooping gate "G" within the respective link perforations 39.

Handle means are attached to the upper portion of the upright shaft 20 for manually rotating same about its vertical-axis 20A, and as indicated by the double-headed curved arrows in FIGS. 3 and 4. Upon rotation about vertical-axis 20A, each link's pivotably restrained first-end 36 is forced to move from rearward latching-station (solid line) to forward locking-station (phantom line). Coincidentally thereto, dog-like projections 17 of gate "G" located within the apertured 39 forwardly co-moving links 35 are forced into very close and tight locking-station proximity with the rearward side of fence fore-post "M". Moreover, the flexible cable-like members 13 of gate "G" become very tightly horizontally longitudinally stretched unlike the undesirable sagging condition 13 shown in FIG. 1. At the forwardly moved locking-station condition (phantom line) for links 35, the first-end 36 becomes forward of shaft 20 while the concave inner surface medial portion 37 then firmly abuts against said shaft 20. Herein, the handle means comprises a bifurcate handle 40 pivotably attached with horizontal pivot-pin 41 to the upper end of shaft 20.

There are arresting means to releasably arrest rotation of the upright shaft 20 after the gate "G" (through dogs 17 and the rearwardly moved links 35) has attained forward locking-station. Such manually releasable arresting means for re-attaining latching-station condition is provided by one or more of, and preferably the combination of, the following structural conditions at locking-station. The concave inner surface medial portion 37 of C-shaped link 35 at locking-station is temporarily maintained in firm abutment against shaft 20. Radial handle 40 (commencing from latching-station) is moveable some 170°–190° to eventually abut against or otherwise temporarily associate with the gate free-end 15 at locking-station. In the latter regard, a bifurcate handle 40 might at locking-station pivot about horizontal pivot-pin 41, as indicated in triple-headed curved arrow in FIG. 2, to surround both sides of gate column 15, additionally, a keeper-pin (not shown) might be removably inserted through horizontal aperture 18 of gate column 15 and locatable as an overlying keeper for handle 40 at locking-station (phantom line in FIG. 3). To release the arresting means from locking-station condition; first, the operator manually removes the keeper-pin from column aperture 18; then, folds handle 40 about pivot-pin 41 tc re-attain the FIG. 2 position thereof, and finally the operator rotates handle 40 in the FIG. 3 counterclockwise direction to turn links 35 away from shaft 20. Thus, gate "G" has re-attained the solid line latching-station, and gate dogs 17 can be upwardly removed from link apertures 39 whereby gate "G" is free to pivot freely at hinges 12.

From the foregoing, the construction and operation of the latching mechanism for longitudinally stretchable farm gates will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be restored to, falling within the scope of the appended claims.

I claim:

1. In combination with an upright farm gate closure for a longitudinally extending fence opening defined by a pair of separated upright stationary fence posts including a fore-post and a rear-post, said farm gate being structurally longitudinally horizontally stretchable between a pair of upright gate terminii including a rearward restrained-end that is pivotably associated with the fence rear-post and a gate forward free-end that is removably latchable to the fence fore-post, an improved latching assembly for maintaining the gate in a longitudinally horizontally stretched locking-station condition wherein the distance between the gate upright free-end and the fence fore-post is minimized, said latching mechanism assembly comprising:

A. An upright elongate lineal shaft having a top-end and a bottom-end, said upright shaft being offset from and rotatably secured to the fore-post and wherein said shaft is rotational about the shaft vertical-axis for an angular extent of about 170°–190° commencing at a latching-station and terminating at a locking-station;

B. A pair of vertically separated radial lugs attached rigidly to and extending radially outwardly from the upright shaft whereby the shaft and lugs are co-rotatable about the shaft vertical-axis;

C. A pair of C-shaped horizontal link members and each having its first-end pivotably attached to a lug at a location radially outwardly from the upright shaft;

D. A pair of vertically separated dogs attached to the gate free-end and forwardly offset therefrom whereby the dogs are removably associatable with said lugs when the gate free-end is at rearward latching-station;

E. Bifurcate handle means pivotably attached to the upper portion of said upright shaft to facilitate rotation thereof whereby the C-shaped members pivotably restrained first-ends are caused to move from rearward latching-station to the forward locking-station; and F. Said bifurcate handle means being pivotal about a horizontal pivot-pin on the upright shaft and from there to surround both sides of the gate columnar free-end to provide an arresting means to arrest rotation of the upright shaft after the gate dogs have attained said forward locking-station.

2. The latching mechanism of claim 1 wherein the arresting means comprises a concave inner medial surface for the C-shaped pivotal link which surface is positioned to releasably firmly abut the elongate upright shaft at locking-station.

3. The latching assembly of claim 1 wherein there is a pair of vertically separated lug stations including a C-shaped member for each station; and wherein the upright lineal shaft is rotatably secured by a pair of bearings including an upper-bearing and a lower-bearing, each of said bearings being removably attached to the fence fore-post with a threaded horizontal stud.

4. The latching mechanism of claim 1 wherein the vertically separated lugs include an upper-lug and a lower-lug and the vertically separated dogs include an upper dog and a lower dog; and wherein the lower dog is vertically lengthier than is the upper depending gate dog.

5. The latching mechanism of claim 4 wherein the upper-lug and the lower-lug are each of a dual-lug configuration with the C-shaped link for each lug being pivotably disposed between the dual-lug configuration.

6. The latching mechanism of claim 1 wherein the upright lineal shaft is rotatably secured by a pair of bearings including an upper-bearing and a lower-bearing, each of said bearings being readily removably attached to the fence fore-post environment with a threaded horizontal stud.

7. The latching mechanism of claim 6 wherein the vertically separated lugs include an upper-lug and a lower-lug; and wherein there are integrally attached means on the shaft and resting upon the lower-bearing thereby maintaining the elevation of the shaft bottom-end above the earth's surface.

8. The latching mechanism of claim 1 wherein the gate free-end upper portion is perforated above the bifurcated radial-handle at arrested condition; and wherein the arresting means additionally comprises a concave inner surface for each C-shaped link which is positioned to firmly abut the upright shaft at the gate locking-station.

9. The gate latching mechanism of claim 8 wherein the upright lineal shaft is rotatably secured by a pair of bearings including an upper-bearing and a lower-bearing, each of said bearings being readily attached to the fence fore-post with a threaded horizontal stud; wherein the pair of vertically separated lugs includes an upper-lug and a lower-lug, and wherein the gate dog for the lower C-shaped link is lengthier than is the gate dog for the upper C-shaped link thereby facilitating latching-condition engagement of the pivotal gate with the gate latching mechanism.

* * * * *